US009332885B1

(12) United States Patent
Todd

(10) Patent No.: US 9,332,885 B1
(45) Date of Patent: May 10, 2016

(54) TOILET DEODORIZING DEVICE

(71) Applicant: Felton Todd, Butler, AL (US)

(72) Inventor: Felton Todd, Butler, AL (US)

( * ) Notice: Subject to any disclaimer, the term of this patent is extended or adjusted under 35 U.S.C. 154(b) by 309 days.

(21) Appl. No.: 14/045,891

(22) Filed: Oct. 4, 2013

(51) Int. Cl.
*E03D 9/00* (2006.01)
*A47K 17/00* (2006.01)

(52) U.S. Cl.
CPC ..... *A47K 17/00* (2013.01); *E03D 9/005* (2013.01); *E03D 9/007* (2013.01)

(58) Field of Classification Search
CPC ..... E03D 9/005; E03D 9/007; A47K 17/00
USPC ..... 4/223, 228.1, 231
See application file for complete search history.

(56) References Cited

U.S. PATENT DOCUMENTS 2,444,441 A * 7/1948 Grinham ..... E03D 9/005 4/223
3,088,126 A * 5/1963 Klingler ..... E03D 9/032 4/231
4,064,573 A 12/1977 Calderone
4,670,916 A * 6/1987 Bloom ..... E03D 9/005 4/231
5,031,259 A 7/1991 Balera et al.
7,603,726 B2 10/2009 Sawalski et al.
7,676,856 B1 3/2010 Graham, II
D643,101 S 8/2011 Abbondanzio et al.
8,136,172 B1 3/2012 Edgecomb
2003/0229938 A1 12/2003 Hayashi et al.

* cited by examiner

*Primary Examiner* — Tuan N Nguyen

(57) ABSTRACT

A toilet deodorizing device automatically dispenses a deodorizer into a toilet when a person sits on a seat of the toilet. The device includes a housing and a deodorizing substance contained in an interior space of the housing. A dispenser is coupled to the housing. The dispenser is actuated by pressing an upper surface of the dispenser towards the housing. A connector extends from the housing positioning the housing in a toilet bowl. The upper surface of the dispenser is positioned over the opening into the toilet bowl such that the dispenser is configured for contacting a seat coupled to the toilet bowl when the seat is in a nearly fully deployed position whereby pressure on the seat into a fully deployed position actuates the dispenser.

10 Claims, 6 Drawing Sheets

TOILET DEODORIZING DEVICE

BACKGROUND OF THE DISCLOSURE

Field of the Disclosure

The disclosure relates to deodorizing devices and more particularly pertains to a new deodorizing device for automatically dispensing a deodorizer into a toilet when a person sits on a seat of the toilet.

SUMMARY OF THE DISCLOSURE

An embodiment of the disclosure meets the needs presented above by generally comprising a housing having a top surface, a bottom surface, and a perimeter wall extending around and between the top surface and the bottom surface defining an interior space. A deodorizing substance is contained in the interior space. A dispenser is coupled to the housing. The dispenser has an inlet positioned in the interior space wherein the deodorizing substance in drawn into the inlet when the dispenser is actuated. The dispenser has an outlet through which the deodorizing substance is dispensed from the interior space when the dispenser is actuated. The dispenser further has an upper surface positioned in spaced relationship to the top surface of the housing. The dispenser is actuated by pressing the upper surface of the dispenser towards the housing. A connector is coupled to and extends from the housing wherein the housing is configured for being positioned in a toilet bowl such that the top surface of the housing is positioned proximate an opening into the toilet bowl. The upper surface of the dispenser is positioned over the opening into the toilet bowl such that the dispenser is configured for contacting a seat coupled to the toilet bowl when the seat is in a nearly fully deployed position whereby pressure on the seat into a fully deployed position actuates the dispenser.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
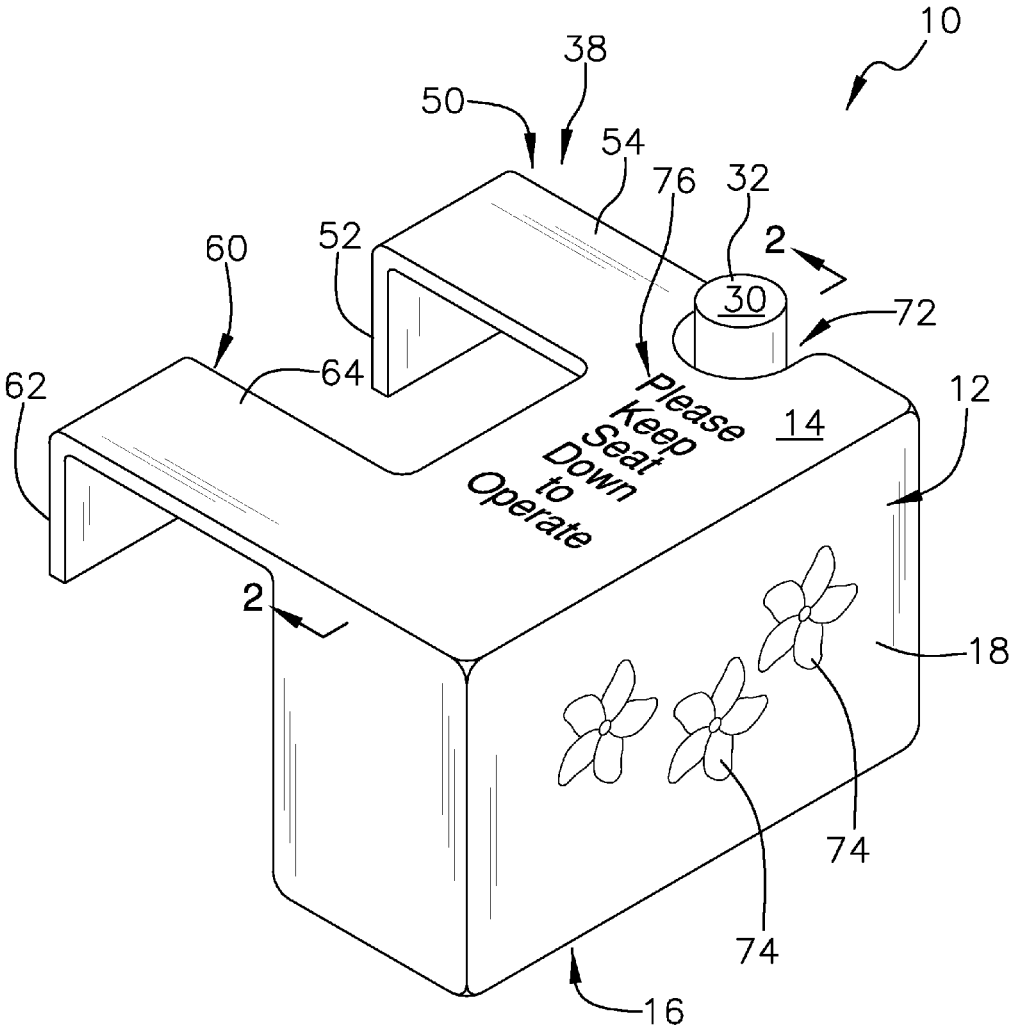
FIG. 1 is a top front side perspective view of a toilet deodorizing device according to an embodiment of the disclosure.
Figure 2:
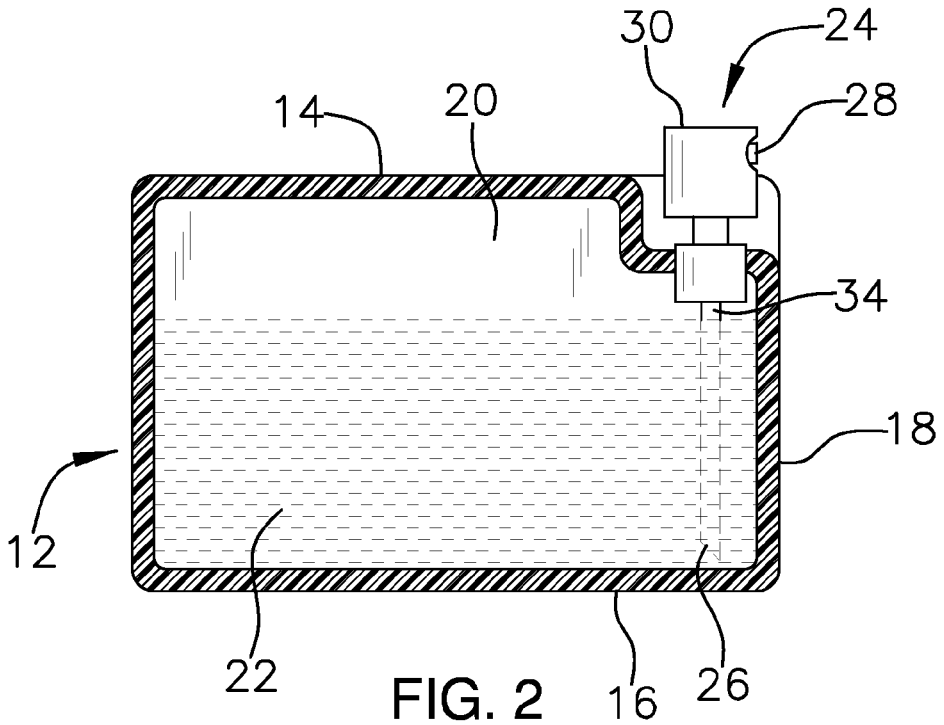
FIG. 2 is a cross-sectional view of an embodiment of the disclosure taken along line 2-2 of FIG. 1.
Figure 3:
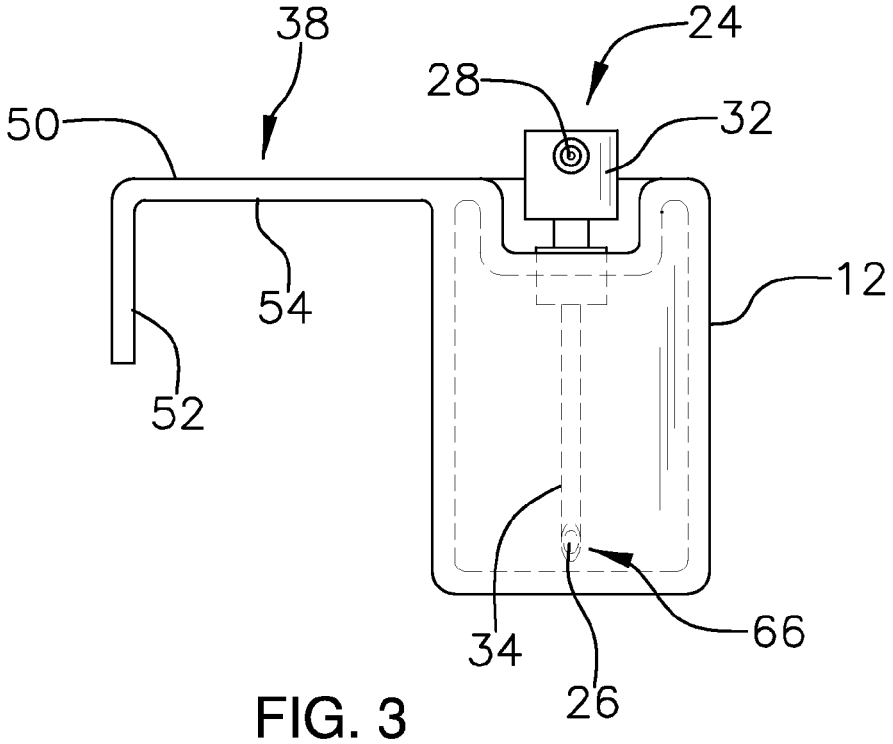
FIG. 3 is a front view of an embodiment of the disclosure.
Figure 4:
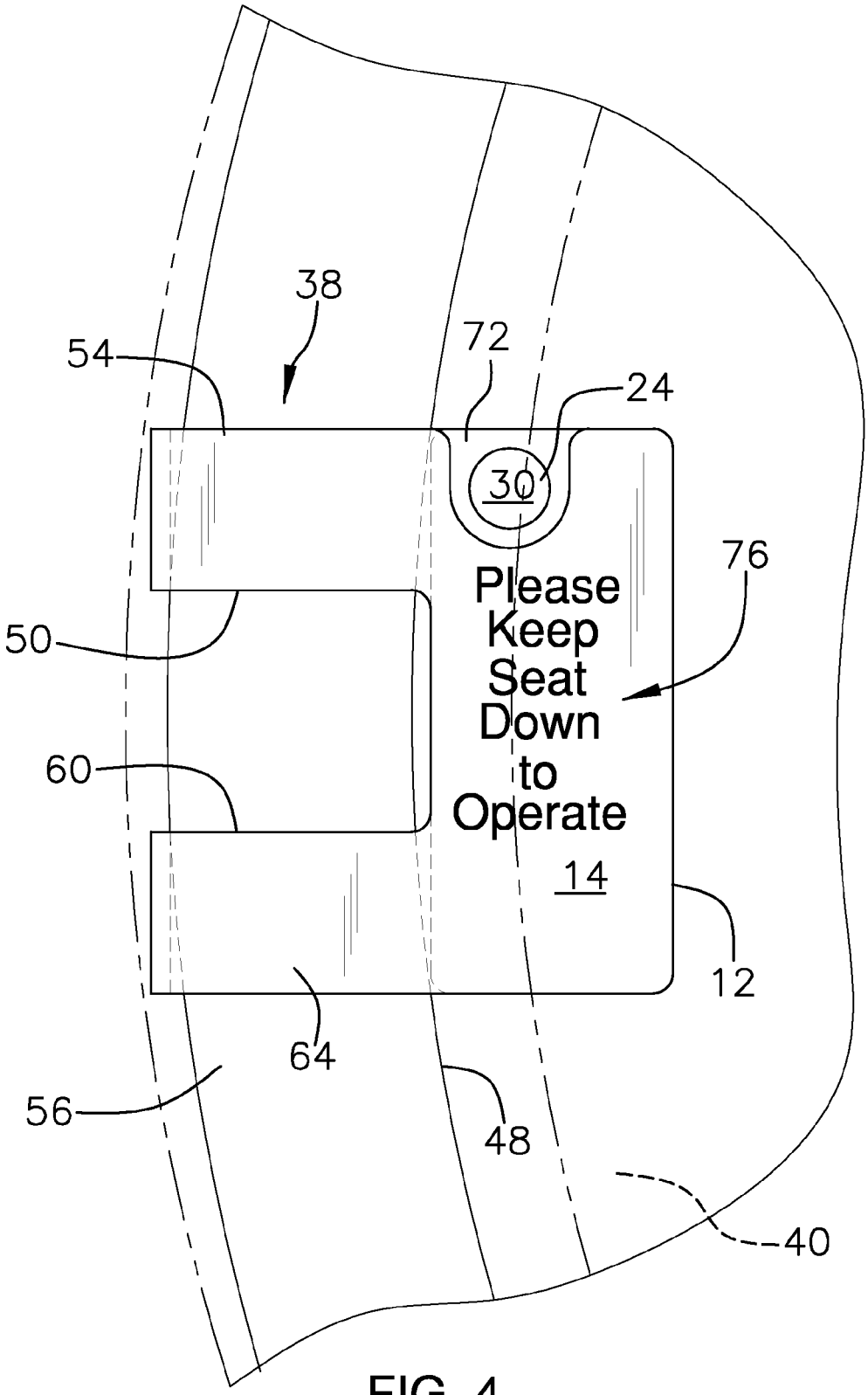
FIG. 4 is a top view of an embodiment of the disclosure.
Figure 5:
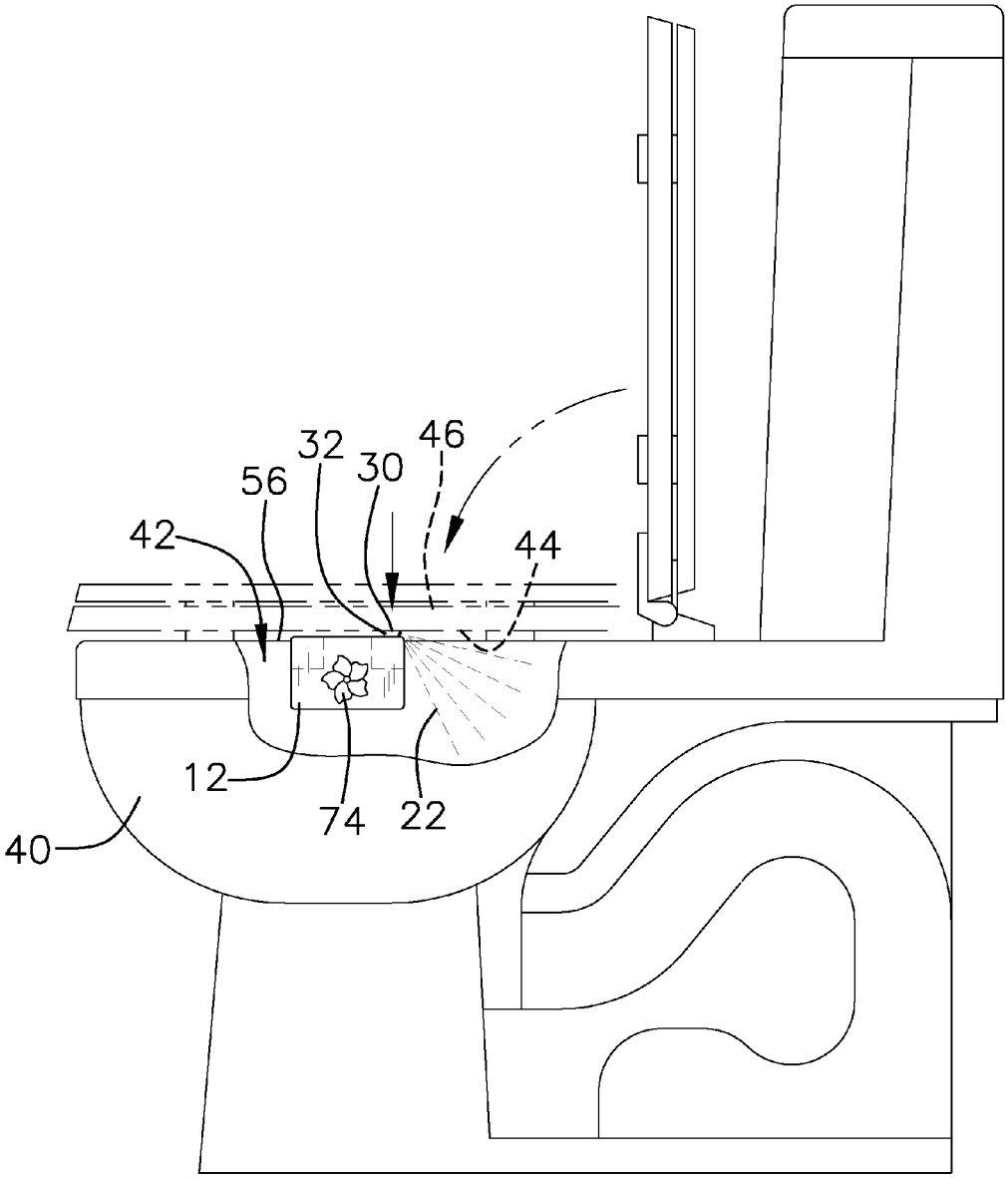
FIG. 5 is a side view of an embodiment of the disclosure in use.
Figure 6:
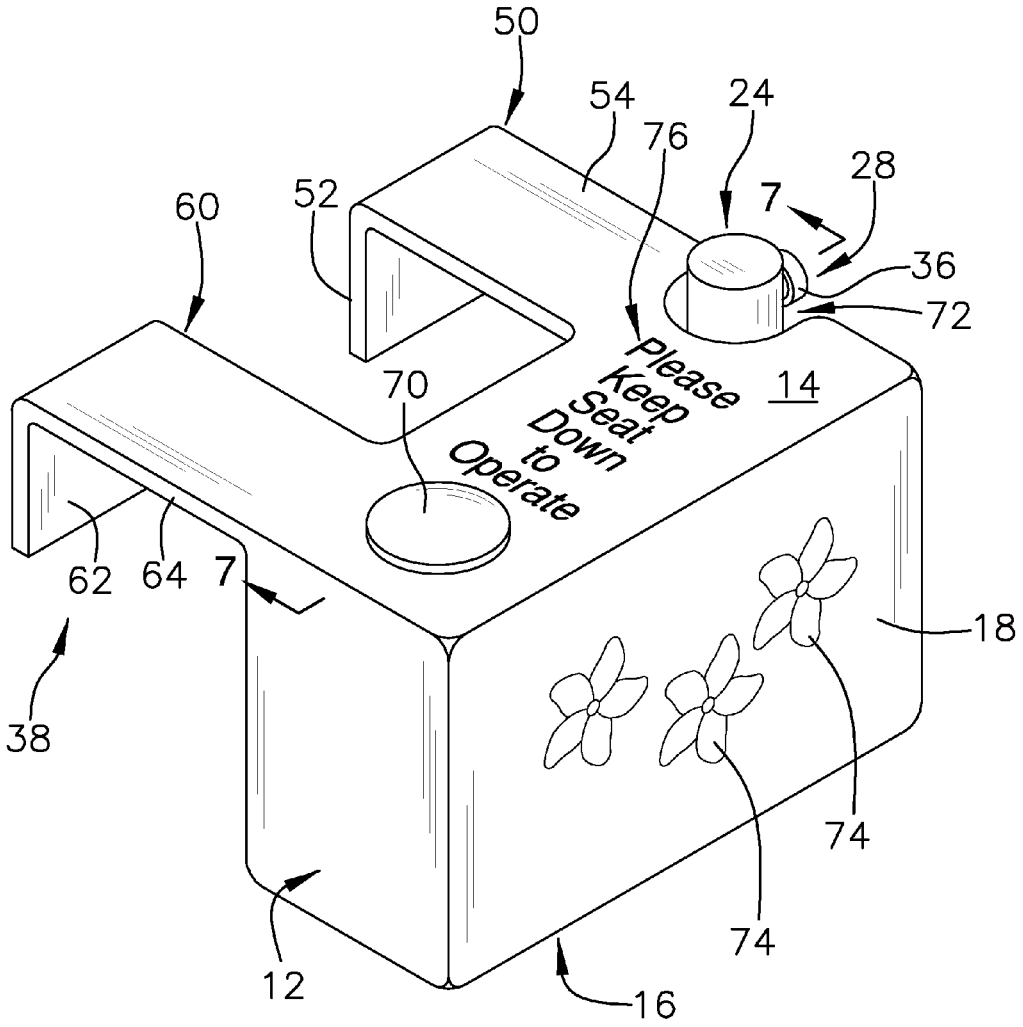
FIG. 6 is a top front side perspective view of an embodiment of the disclosure.
Figure 7:
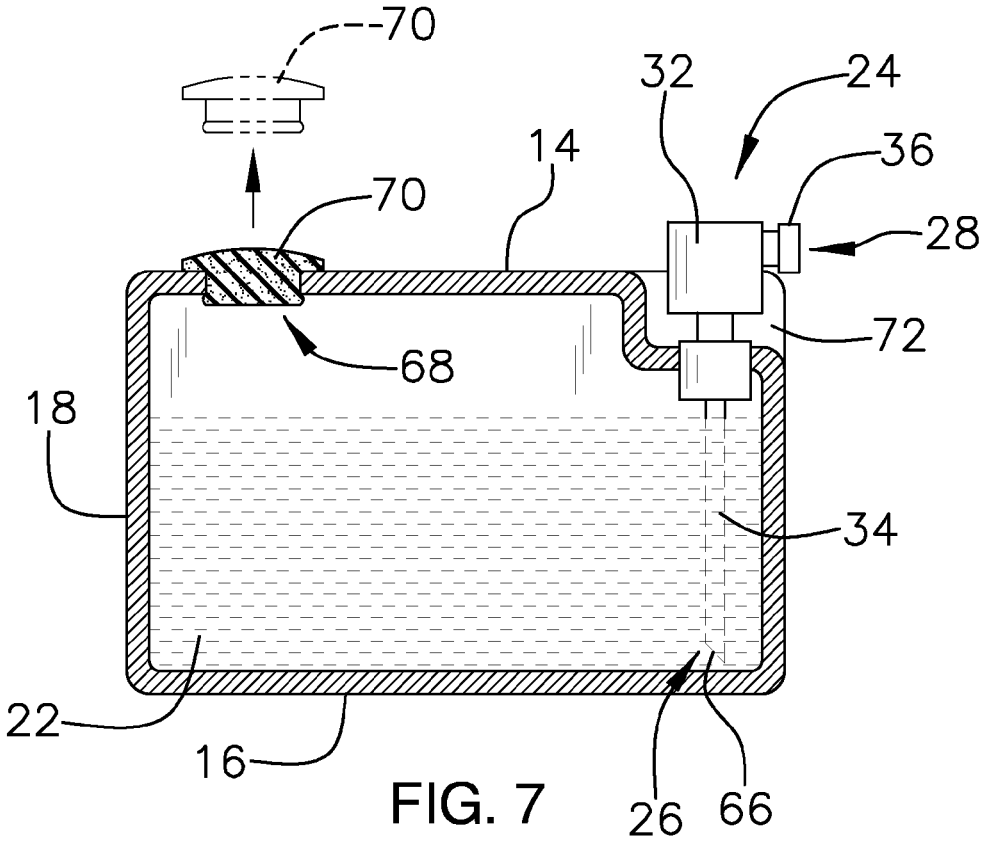
FIG. 7 is a cross-sectional view of an embodiment of the disclosure taken along line 7-7 of FIG. 6.

With reference now to the drawings, and in particular to FIGS. 1 through 7 thereof, a new deodorizing device embodying the principles and concepts of an embodiment of the disclosure and generally designated by the reference numeral 10 will be described.

As best illustrated in FIGS. 1 through 7, the toilet deodorizing device 10 generally comprises a housing 12 having a top surface 14, a bottom surface 16, and a perimeter wall 18 extending around and between the top surface 14 and the bottom surface 16 defining an interior space 20. A deodorizing substance 22 is contained in the interior space 20. A dispenser 24 is coupled to the housing 12. The dispenser 24 has an inlet 26 positioned in the interior space 20 wherein the deodorizing substance 22 is drawn into the inlet 26 when the dispenser 24 is actuated. The dispenser 24 has an outlet 28 through which the deodorizing substance 22 is dispensed from the interior space 20 when the dispenser 24 is actuated. The dispenser 24 may be a spray pump having an upper surface 30 positioned in spaced relationship to the top surface 14 of the housing 12. The dispenser 24 is actuated by pressing the upper surface 30 of the dispenser 24 towards the housing 12. The dispenser 24 may comprise a pump head 32 coupled to a conduit 34 extending downwardly from the pump head 32 through the housing 12 into the interior space 20. The outlet 28 is a nozzle 36 coupled to the pump head 32. The nozzle 36 may be adjustable by twisting of the nozzle 36 or other conventional manipulation for selectively adjusting dispensing of the deodorizing substance 22 from the interior space 20 of the housing 12 when the dispenser 24 is actuated. The nozzle 36 may be conventionally adjusted for varying a spray pattern or a volume of deodorizing substance 22 being dispensed.

A connector 38 is coupled to and extends from the housing 12 wherein the housing 12 is configured for being positioned in a toilet bowl 40 such that the top surface 14 of the housing 12 is positioned proximate an opening 42 into the toilet bowl 40 and the upper surface 30 of the dispenser 24 is positioned over the opening 42 into the toilet bowl 40. Thus, the dispenser 24 is configured for contacting a bottom surface 44 of a seat 46 coupled to the toilet bowl 40 and overhanging an inner edge 48 of a rim 56 defining the opening 42 of the toilet bowl 40. The dispenser 24 first contacts the bottom surface 44 when the seat 46 is in a nearly fully deployed position whereby additional pressure on the seat 46 urging the seat 46 into a fully deployed position actuates the dispenser 24. The connector 38 may comprise a first arm 50 having a distal section 52 relative to the housing 12 and an extension section 54 coupled to and extending between the housing 12 and the distal section 52 of the first arm 50. The distal section 52 of the first arm 50 may be transverse to the extension section 54 of the first arm 50 wherein the first arm 50 is substantially L-shaped. The connector 38 may further comprise a second arm 60 having a distal section 62 relative to the housing 12 and an extension section 64 coupled to and extending between the housing 12 and the distal section 62 of the second arm 60. The distal section 62 of the second arm 60 may be similarly transverse to the extension section 64 of the second arm 60 mirroring the first arm 50. The first arm 50 is positioned in spaced relationship to the second arm 60. The extension section 54 of the first arm 50 may be coplanar with the top surface 14 of the housing 12 and the extension section 64 of the second arm 60 is coplanar with the top surface 14 of the housing 12.

A bottom end 66 of the conduit 34 is slanted relative to a longitudinal axis of the conduit 34 to facilitate drawing the deodorizing substance 22 into through the inlet 26. A fill opening 68 may be provided extending through the top surface 14 of the housing 12. The fill opening 68 is in fluid communication with the interior space 20. A cap 70 is removably coupled to the top surface 14 of the housing 12 selectively closing the fill opening 68.

A notch 72 may extend into the perimeter wall 18 of the housing 12. The pump head 32 is vertically aligned with and extends into the notch 72 such that the pump head 32 is laterally inset from the perimeter wall 18 of the housing 12 permitting the dispenser 24 to be substantially linear allowing linear compression of the dispenser 24 to actuate the dispenser 24.

The housing 12 may be constructed of plastic or the like for a disposable alternative. The housing 12 may also be constructed of aluminum or the like, particularly for a refillable embodiment. Decorative indicia 74 may be positioned on an exterior of the housing 12. Instructive indicia 76 may also be positioned on the top surface 14 of the housing 12 directing a person to put the seat 46 down.

In use, the housing 12 is positioned on the toilet bowl 40 positioning the housing within the toilet bowl 40 with the rim 56 being engaged by the connector 38. Downward pressure on the seat 46 actuates the dispenser 24.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A toilet deodorizing device comprising:

a housing having a top surface, a bottom surface, and a perimeter wall extending around and between said top surface and said bottom surface defining an interior space;

a deodorizing substance being contained in said interior space;

a dispenser coupled to said housing, said dispenser having an inlet positioned in said interior space wherein said deodorizing substance is drawn into said inlet when said dispenser is actuated, said dispenser having an outlet through which said deodorizing substance is dispensed from said interior space when said dispenser is actuated, said dispenser having an upper surface positioned in spaced relationship to said top surface of said housing, said dispenser being actuated by pressing said upper surface of said dispenser towards said housing;

a connector coupled to and extending from said housing wherein said housing is configured for being positioned in a toilet bowl such that said top surface of said housing is positioned proximate an opening into the toilet bowl and said upper surface of said dispenser is positioned over the opening into the toilet bowl such that said dispenser is configured for contacting a seat coupled to the toilet bowl when the seat is in a nearly fully deployed position whereby pressure on the seat into a fully deployed position actuates said dispenser, said connector comprising a first arm having a distal section relative to said housing and an extension section coupled to and extending between said housing and said distal section of said first arm, said distal section of said first arm being transverse to said extension section of said first arm, said connector comprising a second arm having a distal section relative to said housing and an extension section coupled to and extending between said housing and said distal section of said second arm, said distal section of said second arm being transverse to said extension section of said second arm, said first arm being positioned in spaced relationship to said second arm, said extension section of said first arm being coplanar with said top surface of said housing.

2. The device of claim 1, further comprising said extension section of said second arm being coplanar with said top surface of said housing.

3. The device of claim 1, further comprising said dispenser comprising a pump head coupled to a conduit extending downwardly from said pump head through said housing into said interior space.

4. The device of claim 3, further comprising said outlet being a nozzle coupled to said pump head.

5. The device of claim 4, further comprising said nozzle being adjustable for selectively adjusting dispensing of said deodorizing substance from said interior space of said housing when said dispenser is actuated.

6. The device of claim 3, further comprising a bottom end of said conduit being slanted relative to a longitudinal axis of said conduit.

7. The device of claim 1, further comprising a fill opening extending through said top surface of said housing, said fill opening being in fluid communication with said interior space.

8. The device of claim 7, further comprising a cap removably coupled to said top surface of said housing selectively closing said fill opening.

9. The device of claim 3, further comprising a notch extending into said perimeter wall of said housing, said pump head being vertically aligned with and extending into said notch such that said pump head is laterally inset from said perimeter wall of said housing.

10. A toilet deodorizing device comprising:

a housing having a top surface, a bottom surface, and a perimeter wall extending around and between said top surface and said bottom surface defining an interior space;

a deodorizing substance being contained in said interior space;

a dispenser coupled to said housing, said dispenser having an inlet positioned in said interior space wherein said deodorizing substance in drawn into said inlet when said dispenser is actuated, said dispenser having an outlet through which said deodorizing substance is dispensed from said interior space when said dispenser is actuated, said dispenser having an upper surface positioned in spaced relationship to said top surface of said housing, said dispenser being actuated by pressing said upper surface of said dispenser towards said housing, said dispenser comprising a pump head coupled to a conduit extending downwardly from said pump head through said housing into said interior space, said outlet being a nozzle coupled to said pump head, said nozzle being adjustable for selectively adjusting dispensing of said deodorizing substance from said interior space of said housing when said dispenser is actuated;

a connector coupled to and extending from said housing wherein said housing is configured for being positioned in a toilet bowl such that said top surface of said housing is positioned proximate an opening into the toilet bowl and said upper surface of said dispenser is positioned over the opening into the toilet bowl such that said dispenser is configured for contacting a seat coupled to the toilet bowl when the seat is in a nearly fully deployed position whereby pressure on the seat into a fully deployed position actuates said dispenser, said connector comprising a first arm having a distal section relative to said housing and an extension section coupled to and extending between said housing and said distal section of said first arm, said distal section of said first arm being transverse to said extension section of said first arm, said connector comprising a second arm having a distal section relative to said housing and an extension section coupled to and extending between said housing and said distal section of said second arm, said distal section of said second arm being transverse to said extension section of said second arm, said first arm being positioned in spaced relationship to said second arm, said extension section of said first arm being coplanar with said top surface of said housing, said extension section of said second arm being coplanar with said top surface of said housing;

a bottom end of said conduit being slanted relative to a longitudinal axis of said conduit;

a fill opening extending through said top surface of said housing, said fill opening being in fluid communication with said interior space;

a cap removably coupled to said top surface of said housing selectively closing said fill opening; and a notch extending into said perimeter wall of said housing, said pump head being vertically aligned with and extending into said notch such that said pump head is laterally inset from said perimeter wall of said housing.

* * * * *